US009390844B2

(12) United States Patent
Cho et al.

(10) Patent No.: US 9,390,844 B2
(45) Date of Patent: Jul. 12, 2016

(54) CHIP RESISTOR

(71) Applicant: SAMSUNG ELECTRO-MECHANICS CO., LTD., Suwon-Si, Gyeonggi-Do (KR)

(72) Inventors: Sung Hun Cho, Suwon-Si (KR); Young Key Joo Kim, Suwon-Si (KR); Chang Ho Lee, Suwon-Si (KR); Byung Sung Kang, Suwon-Si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 197 days.

(21) Appl. No.: 14/221,822

(22) Filed: Mar. 21, 2014

(65) Prior Publication Data

US 2015/0170804 A1 Jun. 18, 2015

(30) Foreign Application Priority Data

Dec. 16, 2013 (KR) ..... 10-2013-0156607

(51) Int. Cl.

| | |
|---|---|
| ***H01C 1/012*** | (2006.01) |
| ***H01C 7/00*** | (2006.01) |
| ***H01C 7/18*** | (2006.01) |
| ***H01C 17/00*** | (2006.01) |
| ***H01C 17/065*** | (2006.01) |

(52) U.S. Cl.

CPC ..... *H01C 7/003* (2013.01); *H01C 7/18* (2013.01); *H01C 17/006* (2013.01); *H01C 17/06526* (2013.01); *H01C 17/06533* (2013.01)

(58) Field of Classification Search

CPC ..... H01C 1/148; H01C 1/012; H01C 7/003; H01C 17/06533; H01C 17/06526

USPC ..... 338/260, 295, 309, 328, 332, 313, 314

See application file for complete search history.

(56) References Cited

U.S. PATENT DOCUMENTS

| | | | | |
|---|---|---|---|---|
| 6,362,723 | B1 * | 3/2002 | Kawase | H01C 1/14 338/22 R |
| 7,012,501 | B2 * | 3/2006 | Krumphals | H01C 7/18 338/21 |
| 7,038,572 | B2 * | 5/2006 | Huber | H01C 1/01 338/239 |
| 7,152,291 | B2 * | 12/2006 | Ritter | H01C 1/14 29/25.03 |
| 8,026,787 | B2 * | 9/2011 | Choi | H01C 7/003 29/612 |
| 8,451,085 | B1 * | 5/2013 | Tsai | H01C 17/06 338/307 |
| 2002/0130760 | A1 * | 9/2002 | Huber | H01C 1/01 338/309 |

FOREIGN PATENT DOCUMENTS

| | | | |
|---|---|---|---|
| KR | 10-1989-0005770 | B1 | 12/1990 |
| KR | 10-2000-0039613 | A | 7/2000 |

* cited by examiner

*Primary Examiner* — Kyung Lee

(74) *Attorney, Agent, or Firm* — McDermott Will & Emery LLP

(57) ABSTRACT

A chip resistor may include: a body having a plurality of substrates stacked therein; a plurality of resistors formed in the body with respective substrates interposed therebetween and exposed through both end surfaces of the body; and first and second electrodes covering both end surfaces of the body, respectively, and connected to both end portions of the exposed resistors, respectively.

17 Claims, 3 Drawing Sheets

CHIP RESISTOR

CROSS-REFERENCE TO RELATED APPLICATION

This application claims the benefit of Korean Patent Application No. 10-2013-0156607 filed on Dec. 16, 2013, with the Korean Intellectual Property Office, the disclosure of which is incorporated herein by reference.

BACKGROUND

The present disclosure relates to a chip resistor.

In accordance with the trend for the multi-functionalization of mobile devices and improvements in the performance thereof, the use of batteries has increased. Therefore, demand for a chip resistor (CSR) has increased for efficiently managing batteries and detecting charging and discharging currents in a pulse code modulation (PCM) circuit.

In recent times within the electric and electronic products market, as the portability of electronic products has been emphasized, the miniaturization of chip resistors used in electronic products has been demanded.

Currently, 1.0 mm×0.5 mm and 0.6 mm×0.3 mm chip resistors have been released onto the market, while 0.4 mm×0.2 mm chip resistors are scheduled for development and release onto the market.

A chip resistor according to the related art may include a substrate, first and second electrodes formed on both ends of the substrate, respectively, resistors connected to the first and second electrodes, an internal protecting layer and an external protecting layer protecting the resistors, and a plating layer enclosing an outer portion of the substrate.

The external protecting layer may be formed of glass or a polymer and may later be covered by a plating layer.

In this case, since adhesion between the external protecting layer and the plating layer is weak, a small interval between a coating part and the plating layer may be formed. Therefore, the first and second electrodes may be partially exposed, such that electrodes containing silver may be oxidized.

Particularly, in the case in which ambient air contains a sulfur compound such as $H_2S$, electrodes containing silver may be destroyed by the sulfur compound, such that the chip resistor may be damaged.

According to the related art, as one method for preventing the above-mentioned sulfuration phenomenon, the first and second electrodes have been formed of a metal having sulfur resistance.

That is, Au, Ag, and Pd, noble metals, and alloys thereof, have been used as a material for the first and second electrodes.

In addition, as another method for preventing the above-mentioned sulfuration phenomenon, terminals have been sealed so that the electrodes are not in contact with ambient air.

However, according to the related art, noble metals have been used, leading to an increase in manufacturing costs.

Further, in the case in which the terminals are sealed, securing sufficient contact force between the plating layer and the protecting layer has been problematic, and a thick resistor has been formed. Therefore, a thickness of the resistor has been excessively increased, such that there have been many difficulties in designing resistor chips.

SUMMARY

An aspect of the present disclosure may provide a chip resistor capable of being miniaturized, having low resistance implemented therein through including a resistor having an increased area, and having an improved sulfuration resistance feature.

According to an aspect of the present disclosure, a chip resistor may include: a body having a plurality of substrates stacked therein; a plurality of resistors formed in the body with respective substrates interposed therebetween and exposed through both end surfaces of the body; and first and second electrodes covering both end surfaces of the body, respectively, and connected to both end portions of the exposed resistors, respectively.

The first and second electrodes may be extended from both end surfaces of the body to portions of both main surfaces and both side surfaces thereof, respectively.

According to another aspect of the present disclosure, a chip resistor may include: a body having a plurality of substrates stacked therein; a plurality of resistors formed in the body with respective substrates interposed therebetween and exposed through both side surfaces of the body; and first and second electrodes covering both side surfaces of the body, respectively, and connected to both end portions of the exposed resistors, respectively.

The first and second electrodes may be extended from both side surfaces of the body to portions of both main surfaces and both end surfaces thereof, respectively.

The first and second electrodes may be connected to the plurality of resistors in parallel.

The resistors may be formed of at least one of nickel (Ni), chrome (Cr), copper (Cu), palladium (Pd), and an alloy thereof.

A thickness of respective resistors may be 0.2 to 5.0 μm.

A total accumulative thickness of the resistors may be 30 to 300 μm.

The substrate may be formed of a dielectric material or an aluminum oxide ($Al_2O_3$).

A thickness of the substrate may be 0.5 to 5.0 μm.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Exemplary embodiments of the present disclosure will now be described in detail with reference to the accompanying drawings.

A direction of a hexahedron will be defined in order to clearly describe exemplary embodiments of the present disclosure. L, W and T in the accompanying drawings refer to a length direction, a width direction, and a thickness direction, respectively.

Here, the thickness direction may be the same as a stacking direction in which sheets are stacked.

Further, in an exemplary embodiment of the present disclosure, for convenience of explanation, both end surfaces refer to surfaces on which first and second electrodes are formed in the length direction of a body, and side surfaces refer to surfaces vertically intersecting with both end surfaces, respectively.

Chip Resistor

Figure 1:
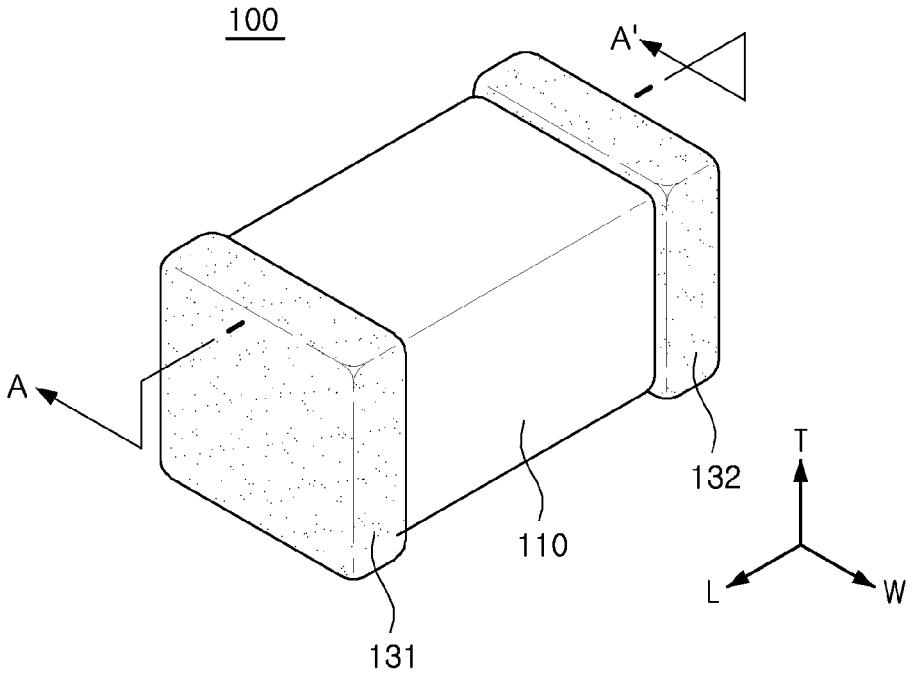
FIG. 1 is a perspective view schematically showing a chip resistor according to an exemplary embodiment of the present disclosure.
Figure 2:
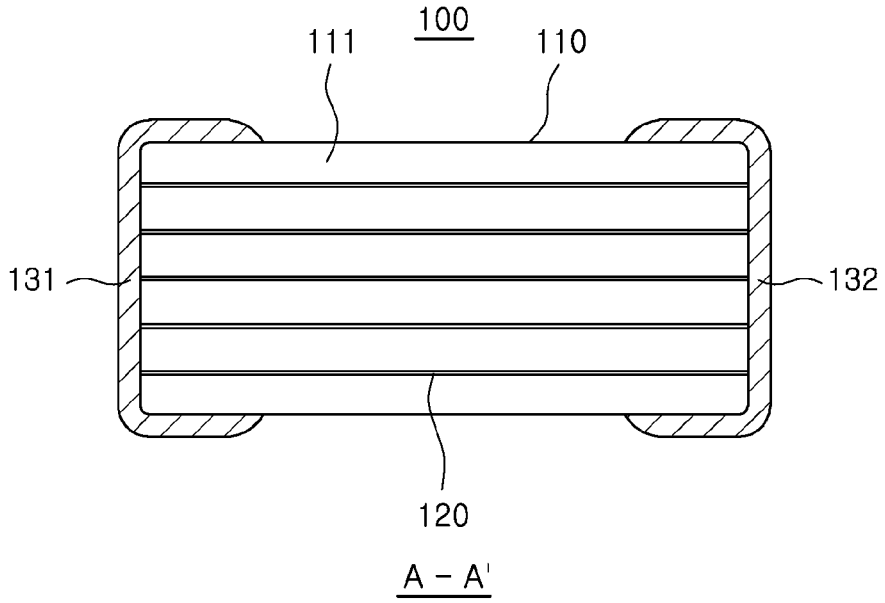
FIG. 2 is a cross-sectional view of line A-A' of FIG. 1.

FIG. 1 is a perspective view schematically showing a chip resistor according to an exemplary embodiment of the present disclosure; FIG. 2 is a cross-sectional view of line A-A' of FIG. 1; and FIG. 3 is a plan view showing a resistor of the chip resistor of FIG. 1.

Figure 3:
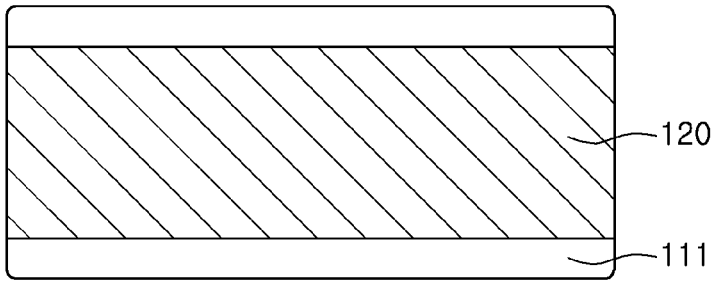
FIG. 3 is a plan view showing a resistor of the chip resistor of FIG. 1.

Referring to FIGS. 1 through 3, a chip resistor 100 according to an exemplary embodiment of the present disclosure may include a body 110, resistors 120, and first and second electrodes 131 and 132 covering both end surfaces of the body 110, respectively.

The body 110 may be formed by stacking and then firing a plurality of substrates 111. A shape and a dimension of the body 110 and the number of stacked substrates 111 are not limited to those of examples shown in FIGS. 1 through 3.

The body 110 may include an active layer contributing to forming resistance of the chip resistor and upper and lower cover layers (not shown) formed above and below the active layer, respectively, as upper and lower margin parts, if necessary.

The active layer may be formed by repeatedly stacking a plurality of resistors 120 with respective substrates 111 interposed therebetween.

Here, a thickness of the substrate 111 may be arbitrarily changed in accordance with a resistance design of the chip resistor 100. Preferably, a thickness of one substrate 111 may be 0.5 to 5.0 μm. However, the present disclosure is not limited thereto.

In addition, the substrate 111, a component on which the resistor 120 is to be mounted, may be formed of a dielectric material or a ceramic material. In an exemplary embodiment of the present disclosure, a material of the substrate 111 is not particularly limited as long as it may have an excellent insulation property and an excellent heat radiation property and may excellently implement close adhesion between the substrate 111 and the resistor 120.

For example, the substrate 111 may be formed of alumina ($Al_2O_3$), if necessary.

In addition, the ceramic material or the dielectric material may contain ceramic powders having a high k, for example, barium titanate ($BaTiO_3$) based powders or strontium titanate ($SrTiO_3$) based powders. However, the present disclosure is not limited thereto.

The upper and lower cover layers may be formed of the same material as that of the substrate 111 of the active layer and have the same configuration as that of the substrate 111 of the active layer except that they do not include the resistors.

The upper and lower cover layers may be formed by stacking one substrate or two or more substrates on upper and lower surfaces of the active layer, respectively, in the thickness direction, and may basically serve to prevent damage to the resistors 120 due to physical or chemical stress.

The resistors 120 may be formed by printing a conductive paste containing a conductive metal at a predetermined thickness on the substrates 111, be simultaneously exposed through both end surfaces of the body 110 in a direction in which the substrates 111 are stacked, and be electrically insulated from each other by the substrates 111 disposed therebetween.

The resistors 120 may be connected to the first and second electrodes 131 and 132 through parts exposed through both end surfaces of the body 110, respectively. In this case, the plurality of resistors 120 may be connected in parallel with each other.

Figure 6:
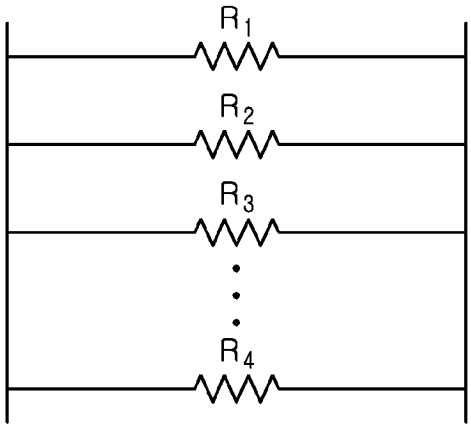
FIG. 6 is a view showing a resistance value of the chip resistor according to an exemplary embodiment of the present disclosure.

Therefore, as shown in the following Equation 1 and FIG. 6, when voltage is applied to the first and second electrodes 131 and 132, current corresponding to the respective resistance values may be divided and flows through the plurality of resistors 120. In this case, a resistance value of the chip resistor 100 may be an inverse number of a total sum of inverse numbers of the respective resistance values of the plurality of resistors 120.

$$1/R_T=1/R_1+1/R_2+1/R_3+\ldots+1/R_n \quad \text{[Equation 1]}$$

Thicknesses of the resistors 120 may be determined depending on a use of the chip resistor. For example, the thickness of the resistors 120 may be determined to be in the range of 0.2 to 5.0 μm in consideration of a size of the body 110. However, the present disclosure is not limited thereto.

Here, in the case in which the thicknesses of the resistors 120 are excessively thin, the plurality of resistors 120 may be bent or broken in a process in which they are stacked and fired.

In addition, a total accumulative thickness of the resistors 120 may be 30 to 300 μm.

In addition, the conductive metal included in the conductive paste forming the resistors 120 may be at least one of nickel (Ni), chrome (Cr), copper (Cu), palladium (Pd), and an alloy thereof. However, the present disclosure is not limited thereto.

In addition, as a method of printing the conductive paste, a screen printing method, a gravure printing method, or the like, may be used. However, the present disclosure is not limited thereto.

The first and second electrodes 131 and 132 may be formed of a conductive paste containing a conductive metal. Here, the conductive metal may be nickel (Ni), copper (Cu), palladium (Pd), gold (Au), or an alloy thereof. However, the present disclosure is not limited thereto.

Here, the first and second electrodes 131 and 132 may be extended from both end surfaces of the body 110 to portions of both main surfaces and both side surfaces thereof, respectively.

Therefore, the first and second electrodes 131 and 132 may serve to prevent damage to the resistors 120 due to physical or chemical stress and prevent deterioration of reliability of the resistors 120 due to permeation of moisture or foreign materials into the body 110.

In addition, plating layers may be formed on the first and second electrodes 131 and 132, if necessary.

The plating layers may be formed of a material having excellent acid resistance and excellent heat resistance and may include first and second plating layers that are sequentially formed, wherein the first plating layer may be formed of, for example, tin (Sn) and the second plating layer may be formed of, for example, nickel (Ni).

In an exemplary embodiment of the present disclosure, the resistors 120 may be configured in a multilayer structure, and lengths and areas of the resistors 120 may be increased when the number of layers thereof is increased in parallel.

Therefore, a sufficient effective area of the resistor 120 may be secured, electrical characteristics of the chip resistor may be improved (for example, a low resistance value may be implemented, or the like), and electrostatic discharge (ESD) characteristics may be further improved.

In addition, when the sufficient effective area of the resistor 120 is secured as described above, a low resistance range may be accurately and easily obtained.

Meanwhile, in a chip resistor according to the related art, only an electrode is formed below a boundary surface between an external protecting layer and a plating layer. Therefore, when the electrode is short-circuited, the chip resistor may be short-circuited.

However, in the chip resistor according to an exemplary embodiment of the present disclosure, the plurality of resistors 120 may be configured in the multilayer structure in which they are overlapped with each other. Therefore, even in the case in which a defect occurs in some of the resistors 120 due to short-circuit, the first and second electrodes 131 and 132 formed on both end surfaces of the body 110, respectively, and the resistors 120 may be maintained in a state in which they are connected to each other to thereby prevent disconnection of the chip resistor.

That is, since the first and second electrodes 131 and 132 and the resistors 120 may be maintained in the state in which they are connected to each other to thereby prevent the disconnection of the chip resistor even in the case in which the defect occurs in some of the resistors 120 due to the short-circuit, electrical connectivity of the resistors 120 may be secured without adding expensive noble metals to the electrode as in the related art.

In addition, since the resistors in an insulator are not exposed in the air, a phenomenon that the electrode is short-circuit due to a sulfuration phenomenon caused by only silver (Ag) or by a small amount of palladium (Pd) added to silver (Ag) may be prevented, and a cost required for manufacturing the chip resistor 100 may be decreased.

A thick film type chip resistor according to the related art has a resistance value implementation range of 7 mΩ to 1Ω based on a 1608 size, and a metal plate generally has a resistance value implementation range of 0.5 mΩ to 10 mΩ.

However, a multilayer chip resistor according to an exemplary embodiment of the present disclosure may have a resistance value implementation range of 0.2 mΩ to 500 mΩ, which is lower than those of the thick film type chip resistor according to the related art and the metal plate.

Modified Example

Figure 4:
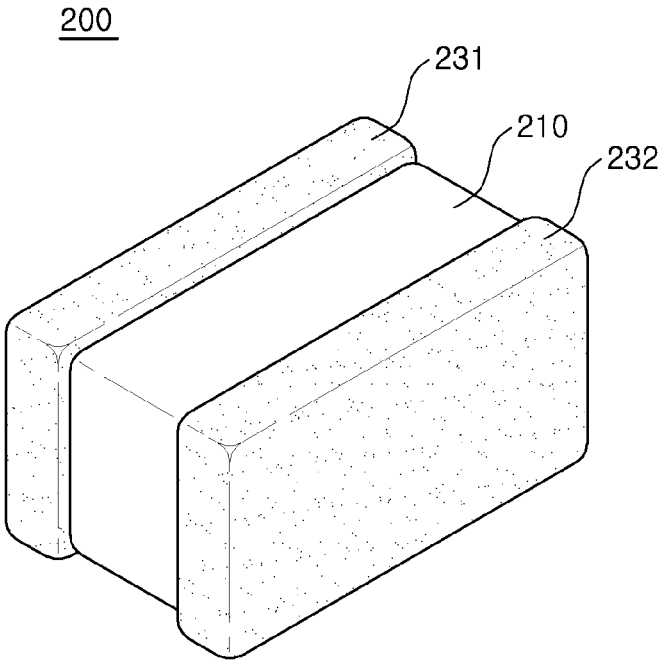
FIG. 4 is a perspective view schematically showing a chip resistor according to another exemplary embodiment of the present disclosure.
Figure 5:
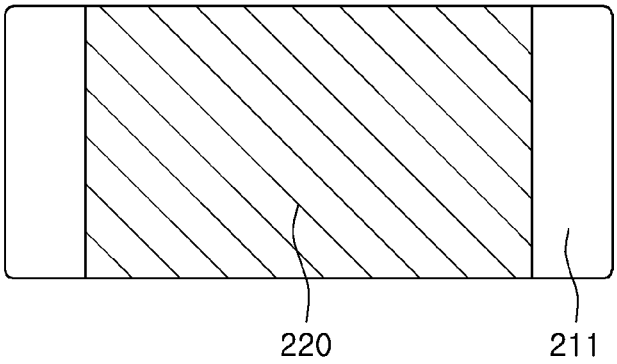
FIG. 5 is a plan view showing a resistor of the chip resistor of FIG. 4.

FIG. 4 is a perspective view schematically showing a chip resistor according to another exemplary embodiment of the present disclosure; and FIG. 5 is a plan view showing a resistor of the chip resistor of FIG. 4.

Here, since configurations of substrates 211, a body 210, resistors 220, and first and second electrodes 231 and 232 are similar to those of the substrates 111, the body 110, the resistors 120, and the first and second electrodes 131 and 132 of the chip resistor 100 of an exemplary embodiment of the present disclosure described above, a detailed description thereof will be omitted in order to avoid an overlapped description, and a structure different from that of the chip resistor 100 of an exemplary embodiment of the present disclosure described above will be described in detail.

Referring to FIGS. 4 and 5, a chip resistor 200 according to another exemplary embodiment of the present disclosure may include a body 210 having a plurality of substrates 211 stacked therein, resistors 220 exposed through both side surfaces of the body 210, and first and second electrodes 231 and 232 covering both side surfaces of the body 210, respectively.

Here, the first and second electrodes 231 and 232 may be extended from both side surfaces of the body 210 to portions of both main surfaces and both end surfaces thereof, respectively.

In the case in which the first and second electrodes 231 and 232 are formed on both side surfaces of the body 210, respectively, as described above, when the chip resistor is mounted on a board, a bonding area may be further increased and a distance between the first and second electrodes 231 and 232 may be shortened to increase tolerance to warpage of the board due to thermal stress, such that more excellent solder bonding reliability may be realized.

In addition, a low resistance value may be easily formed due to a wide effective area of the resistor, and a heat radiating effect may be excellent, such that power characteristics may be improved.

As set forth above, according to exemplary embodiments of the present disclosure, the plurality of resistors are formed in a multilayer structure and are connected to the electrodes in a parallel structure, such that a size thereof may be significantly decreased and an area thereof may be increased to implement a low resistance value.

In addition, in the case in which the chip resistor is formed in a parallel structure according to an exemplary embodiment of the present disclosure, a plurality of resistor layers are compositively used, such that resistance distribution may be decreased.

In addition, according to exemplary embodiments of the present disclosure, since the electrodes and the resistors may be maintained in the state in which they are connected to each other to thereby prevent disconnection of the chip resistor even in the case in which a defect occurs in some of the stacked resistors 120 due to the short-circuit, electrical connectivity of the chip resistor may be secured without using a separate sulfuration prevent means.

In addition, since the resistors in an insulator are not exposed in the air, a phenomenon that the electrode is short-circuit due to a sulfuration phenomenon caused by only silver (Ag) or by a small amount of palladium (Pd) added to silver (Ag) may be prevented. Therefore, a cost required for manufacturing the chip resistor may be decreased.

While exemplary embodiments have been shown and described above, it will be apparent to those skilled in the art that modifications and variations could be made without departing from the spirit and scope of the present disclosure as defined by the appended claims.

What is claimed is:

1. A chip resistor comprising:

a body having a plurality of substrates stacked therein;

a plurality of resistors formed in the body, each resistor interposed between respective substrates, and extended beyond both end surfaces of the body; and first and second electrodes covering both end surfaces of the body, respectively, and connected to both end portions of the resistors, respectively, wherein each resistor is substantially rectangular having a constant width over a length, and a thickness of a gap between an uppermost resistor among the plurality of resistors and an upper surface of the body is substantially the same as a thickness of a gap between a lowermost resistor among the plurality of resistors and a lower surface of the body.

2. The chip resistor of claim 1, wherein the first and second electrodes are connected to the plurality of resistors in parallel.

3. The chip resistor of claim 1, wherein the first and second electrodes are extended from both end surfaces of the body to portions of both main surfaces and both side surfaces thereof, respectively.

4. The chip resistor of claim 1, wherein the resistors are formed of at least one of nickel (Ni), chrome (Cr), copper (Cu), palladium (Pd), and an alloy thereof.

5. The chip resistor of claim 1, wherein a thickness of respective resistors is 0.2 to 5.0 μm.

6. The chip resistor of claim 1, wherein a total accumulative thickness of the resistors is 30 to 300 μm.

7. The chip resistor of claim 1, wherein the substrate is formed of a dielectric material.

8. The chip resistor of claim 1, wherein the substrate is formed of an aluminum oxide ($Al_2O_3$).

9. The chip resistor of claim 1, wherein a thickness of the substrate is 0.5 to 5.0 μm.

10. A chip resistor comprising:

a body having a plurality of substrates stacked therein;

a plurality of resistors formed in the body, each resistor being interposed between respective substrates, and extended to be exposed to both side surfaces of the body in the width direction; and first and second electrodes covering both side surfaces of the body in the width direction, respectively, and connected to both end portions of the resistors, respectively, wherein the first and second electrodes are extended from both side surfaces of the body to portions of both main surfaces and both end surfaces thereof, respectively.

11. The chip resistor of claim 10, wherein the first and second electrodes are connected to the plurality of resistors in parallel.

12. The chip resistor of claim 10, wherein the resistors are formed of at least on of nickel (Ni), chrome (Cr), copper (Cu), palladium (Pd), and an alloy thereof.

13. The chip resistor of claim 10, wherein a thickness of respective resistors is 0.2 to 5.0 μm.

14. The chip resistor of claim 10, wherein a total accumulative thickness of the resistors is 30 to 300 μm.

15. The chip resistor of claim 10, wherein the substrate is formed of a dielectric material.

16. The chip resistor of claim 10, wherein the substrate is formed of an aluminum oxide ($Al_2O_3$).

17. The chip resistor of claim 10, wherein a thickness of the substrate is 0.5 to 5.0 μm.

* * * * *